US011193444B2

(12) United States Patent
Nakamura

(10) Patent No.: US 11,193,444 B2
(45) Date of Patent: Dec. 7, 2021

(54) FUEL INJECTION VALVE CONTROL DEVICE AND CONTROL METHOD FOR THE SAME

(71) Applicant: DENSO CORPORATION, Kariya (JP)

(72) Inventor: Masami Nakamura, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/101,263

(22) Filed: Nov. 23, 2020

(65) Prior Publication Data

US 2021/0071613 A1 Mar. 11, 2021

Related U.S. Application Data

(63) Continuation of application No. PCT/JP2019/019920, filed on May 20, 2019.

(30) Foreign Application Priority Data

May 25, 2018 (JP) ..... JP2018-100708

(51) Int. Cl.

| | |
|---|---|
| ***F02D 41/40*** | (2006.01) |
| ***F02D 41/24*** | (2006.01) |
| ***F02M 51/06*** | (2006.01) |
| *F02D 41/38* | (2006.01) |

(52) U.S. Cl.

CPC ..... *F02D 41/40* (2013.01); *F02D 41/2429* (2013.01); *F02M 51/061* (2013.01); *F02D 2041/389* (2013.01); *F02D 2200/0614* (2013.01); *F02D 2200/0618* (2013.01)

(58) Field of Classification Search

CPC .... F02D 41/40; F02D 41/2429; F02D 41/247; F02D 41/20; F02D 2041/389; F02M 51/061

USPC ..... 123/490; 251/129.01; 701/103–105

See application file for complete search history.

(56) References Cited

U.S. PATENT DOCUMENTS

| | | | | |
|---|---|---|---|---|
| 7,000,600 | B1 * | 2/2006 | Yamada | F02D 41/40 123/501 |
| 10,859,010 | B2 * | 12/2020 | Hoshi | F02D 19/0636 |
| 2014/0366848 | A1 | 12/2014 | Fujii et al. | |

(Continued)

FOREIGN PATENT DOCUMENTS

| | | |
|---|---|---|
| JP | 2002-201992 | 7/2002 |
| JP | 2015-129445 | 7/2015 |

*Primary Examiner* — Hai H Huynh

(74) *Attorney, Agent, or Firm* — Nixon & Vanderhye P.C.

(57) ABSTRACT

An actuator is energized to cause a valve body of a fuel injection valve to perform fuel injection. The actuator includes a driving body to drive to open and close the valve body. Boundary energization is performed that ends energization of the actuator at a timing when the driving body is moved in an opening direction of the valve body and is assumed to have reached an end of its movement range to measure a relationship between the energization time until the energization ends and the fuel injection amount. A correspondence relationship between the energization time of the actuator and the fuel injection amount is determined by using the measured relationship. An energization time corresponding to a target injection amount is obtained with reference to the determined correspondence relationship. The actuator is energized to cause the fuel injection valve to perform fuel injection.

8 Claims, 10 Drawing Sheets

(56) References Cited

U.S. PATENT DOCUMENTS

| | | | |
|---|---|---|---|
| 2016/0245211 | A1 | 8/2016 | Katsurahara et al. |
| 2019/0203687 | A1 | 7/2019 | Yanoto |

* cited by examiner

FUEL INJECTION VALVE CONTROL DEVICE AND CONTROL METHOD FOR THE SAME

CROSS REFERENCE TO RELATED APPLICATION

The present application is a continuation application of International Patent Application No. PCT/JP2019/019920 filed on May 20, 2019, which designated the U.S. and claims the benefit of priority from Japanese Patent Application No. 2018-100708 filed on May 25, 2018. The entire disclosures of all of the above applications are incorporated herein by reference.

TECHNICAL FIELD

The present disclosure relates to a control technique for a fuel injection valve.

BACKGROUND

Conventionally, a fuel injection valve is used to inject fuel to an internal combustion engine.

SUMMARY

According to an aspect of the present disclosure, a fuel injection control device includes a fuel injection valve configured to receive fuel and to inject fuel by opening and closing a valve body; an actuator including a driving body configured to drive the valve body of the fuel injection valve in an opening direction and a closing direction of the valve body; and an energization control unit configured to energize the actuator to perform fuel injection.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
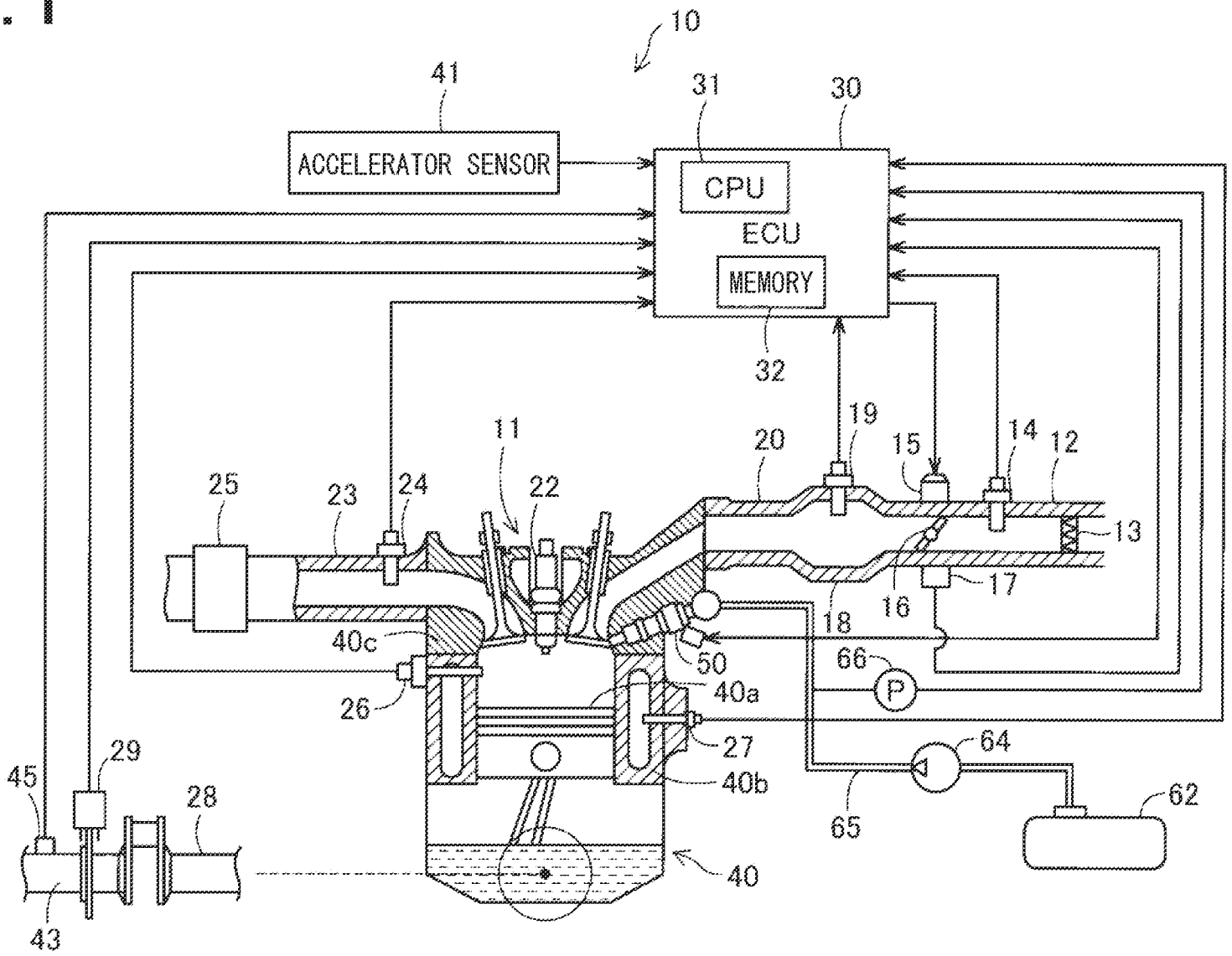
FIG. 1 is a schematic configuration diagram showing a hardware configuration of an embodiment.

As follows, examples of the present disclosure will be described.

According to an example, in a fuel injection valve that injects fuel to an internal combustion engine, an actuator such as a solenoid is driven to open and close a valve body. A scheme of the opening and closing of the valve body includes, so-called, full lift, in which the actuator is energized until the valve body is completely opened, and partial lift, in which the energization is ended before the valve body is completely opened. A delay time arises from the start of energization of the actuator to the start of movement of the valve body. In addition, such a delay time varies among actuators. Therefore, it has been difficult to accurately control the opening and closing of the fuel injection valve at the time of the partial lift.

In view of this, according to an example, a configuration is assumable to measure the delay time at the time of the full lift and to control the valve body in consideration of the measured delay time at the time of the partial lift. However, even in the configuration to measure the delay time at the time of the full lift and to control the movement of the valve body at the time of the partial lift, a concern arises that the accuracy of control of the fuel injection amount may not be sufficient.

According to an example, a fuel injection control device is provided. This fuel injection control device includes a fuel injection valve configured to receive fuel and to inject fuel by opening and closing a valve body; an actuator including a driving body configured to drive the valve body of the fuel injection valve in an opening direction and a closing direction of the valve body; and an energization control unit configured to energize the actuator to perform fuel injection for an energization time corresponding to a target injection amount with reference to a correspondence relationship between the energization time of the actuator and a fuel injection amount. The energization control unit is configured to perform boundary energization to end energization of the actuator at a timing when the driving body moves in the opening direction of the valve body and is assumed to reach an end of its movement range. The energization control unit is configured to measure a relationship between the energization time until the end of the energization and the fuel injection amount and to determine the correspondence relationship by using the relationship.

This fuel injection control device measures the relationship between the energization time until the end of energization and the fuel injection amount and determines the correspondence relationship by using this measured relationship when performing the boundary energization to end the energization of the actuator at the timing when the driving body moves in the opening direction of the valve body and is assumed to have reached the end of the movement range. Therefore, the fuel injection amount can be accurately controlled by using the determined correspondence relationship.

In addition, this may be implemented as a method for controlling the fuel injection valve. Further, this may be implemented as a control method for a fuel injection control device, may be implemented as a control device for an engine such as an internal combustion engine, or may be implemented as a control method for the same.

A. Configuration of the First Embodiment (1) Hardware Configuration Common to the Embodiments:

A hardware configuration of a fuel injection control system 10 of the embodiments will be described. In order to facilitate the ease of understanding, the same reference numerals are attached to the same constituent elements in each drawing where possible, and redundant explanations are omitted.

As shown in FIG. 1, the fuel injection control system 10 includes a cylinder injection type engine 11 (hereinafter also simply referred to as "engine 11"), which is an internal combustion engine of a cylinder injection type, and an electronic control unit (hereinafter "ECU") 30. The fuel injection control system 10 is configured to control the operation of the engine 11 by using the ECU 30. The engine 11 has multiple cylinders 40 and is, for example, an in-line four-cylinder engine having four cylinders 40. FIG. 1 illustrates only a single cylinder 40 and a pipe system connected to the single cylinder 40.

An air cleaner 13 is provided at the most upstream part of an intake pipe 12 of the internal combustion engine 11. An airflow meter 14 is provided downstream of the air cleaner 13 for detecting an intake air amount. A throttle valve 16 whose opening is adjusted by a motor 15 and a throttle opening sensor 17 which detects the opening (throttle opening degree) of the throttle valve 16 are provided on the downstream side of the airflow meter 14.

A surge tank 18 is further provided on the downstream side of the throttle valve 16. An intake pipe pressure sensor 19 for detecting an intake pipe pressure is provided in the surge tank 18. In addition, the surge tank 18 is provided with an intake manifold 20 that conducts air into each cylinder 40 of the engine 11.

The cylinder 40 is defined with a piston 40*a* and a cylinder 40*b*. Each cylinder 40 of the engine 11 is provided with a fuel injection valve 50 that directly injects fuel into the cylinder. Fuel is supplied to the fuel injection valve 50 from a fuel tank 62 by using a fuel pump 64. A fuel supply pipe 65 for supplying fuel is provided with a pressure sensor 66 for detecting the supply pressure of fuel. Further, a spark plug 22 is attached to a cylinder head 40*c* above the cylinder 40*b* for each cylinder 40. The spark plug 22 ignites mixture in the cylinder with spark discharge in each cylinder 40.

Figure 2:
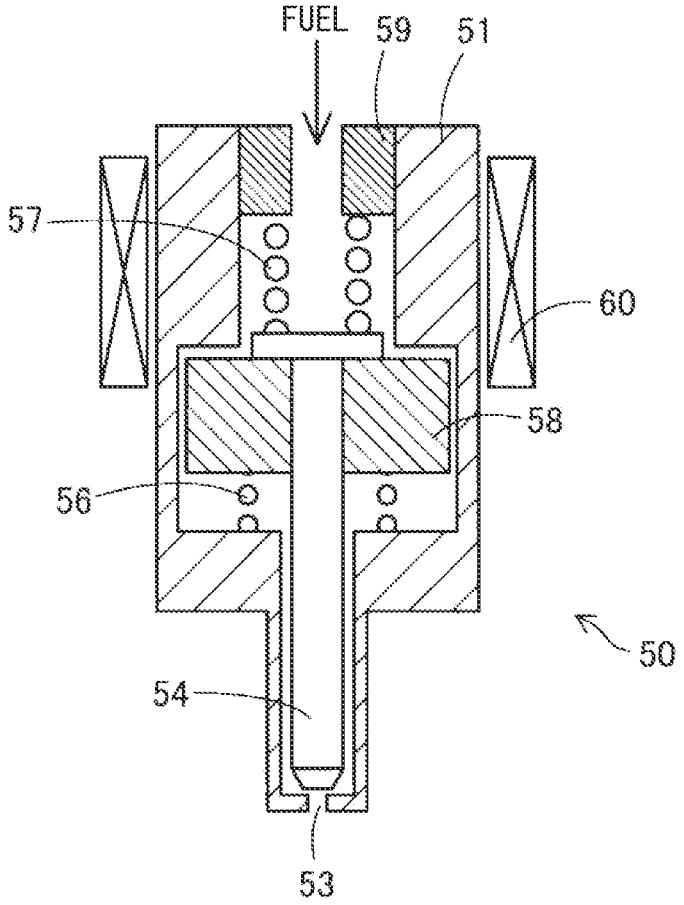
FIG. 2 is a schematic configuration diagram showing a structure of a fuel injection valve.

The fuel injection valve 50 is a known electromagnetically driven type (solenoid type) injector. As shown in FIG. 2, the fuel injection valve 50 energizes a drive coil 60 of the built-in solenoid to cause the drive coil 60 to form a magnetic flux to lift a needle valve 54. The needle valve 54 is a valve body provided in a case 51 that forms a fuel supply path. In this way, the fuel injection valve 50 opens and closes an opening 53 formed in the tip of the case 51 to perform fuel injection. The fuel injection valve 50 includes, in addition to the needle valve 54 as the valve body, a plunger 58 as a driving body fixed to the needle valve 54, two coil springs 56, 57 for urging the plunger 58 as a whole toward the opening 53, and a supply hole plug 59 that functions as a backup member for the coil spring 57. The supply hole plug 59 has a supply hole at the center for receiving supplied fuel. Fuel to be supplied to the fuel injection valve 50 is boosted in pressure by using the fuel pump 64 to a pressure that enables in-cylinder injection, and the fuel is supplied through the fuel supply pipe 65.

In the fuel injection valve 50, the solenoid is integrated with the fuel injection valve 50. Therefore, a solenoid is not an individual component. It is noted that, the plunger 58 as the driving body for driving the needle valve 54 and the drive coil 60 for generating electromagnetic force to attract the plunger 58 form the solenoid. From the viewpoint of the ECU 30, the ECU 30 controls the energization time of the drive coil 60, and the drive coil 60 may be construed as an actuator. When the drive coil 60 of the built-in solenoid is energized, the fuel injection valve 50 lifts the tip end of the needle valve 54, which is integrated with the plunger 58, with the electromagnetic force generated by using the drive coil 60 in the direction in which the tip end is separated from the opening 53. When the tip of the needle valve 54 is separated from the opening 53, the fuel injection valve 50 is opened, and high-pressure fuel supplied to the supply hole is injected into the cylinder of the engine 11. In the fuel injection valve 50, when the energization of the drive coil 60 is stopped, the needle valve 54 is returned toward the opening 53 with the force of the coil spring 57 and is closed. Thus, the fuel injection is stopped. The fuel injection valve 50 is provided with a terminal for energization and is connected to the ECU 30. The drive coil 60 is connected to the terminal for energization. The ECU 30 is configured to energize the drive coil 60 at a desired timing.

An exhaust pipe 23 is connected to each cylinder 40 of the engine 11. The exhaust pipe 23 is provided with an exhaust gas sensor 24 (air-fuel ratio sensor, an oxygen sensor, or the like) to detect an air-fuel ratio or a rich/lean state of exhaust gas. A catalyst 25 such as a three-way catalyst to purify the exhaust gas is provided on the downstream side of the exhaust gas sensor 24.

An in-cylinder pressure sensor 26 that detects an in-cylinder pressure and a cooling water temperature sensor 27 that detects a cooling water temperature are attached to the cylinder 40*b* of the engine 11. A crankshaft 28 that converts a reciprocating motion of the piston 40*a* into a circular motion is connected to each piston 40*a*. A crank angle sensor 29 that outputs a pulse signal each time the crankshaft 28 rotates by a predetermined crank angle is attached to the outer peripheral side of the crankshaft 28. An output shaft 43 is coupled to the crankshaft 28 for extracting power to the outside, and a torque sensor 45 is provided thereto.

The detection signals output from these various sensors are input to the ECU 30. In particular, the ECU 30 reads the intake air amount detected by using the airflow meter 14, the opening of the throttle valve 16 detected by using the throttle opening sensor 17, the intake pipe pressure detected by using the intake pipe pressure sensor 19, the air-fuel ratio detected by using the exhaust gas sensor 24, the in-cylinder pressure detected by using the in-cylinder pressure sensor 26, the cooling water temperature detected by using the cooling water temperature sensor 27, the crank angle detected by using the crank angle sensor 29, the fuel supply pressure detected by using the pressure sensor 66, the output torque of the engine 11 detected by using the torque sensor 45, and the like. The ECU 30 grasps the operating state of the engine 11. Further, with regard to the drive coil 60 that forms the solenoid of the fuel injection valve 50, the ECU 30 is configured to monitor at least one of the voltage applied to the drive coil 60 and the current flowing through the drive coil 60. The voltage or the current applied to the drive coil 60 is used to determine the correspondence relationship between the energization time on the drive coil 60 and the fuel injection amount, which will be described later. In addition to the signals described above, the ECU 30 inputs an output signal from an accelerator sensor 41 that detects a depression amount (accelerator operation amount) of an accelerator pedal (not shown).

The ECU 30 that receives these signals mainly includes a microcomputer (CPU) 31 and executes various engine control programs stored in a built-in memory 32 to control the injection amount, the ignition timing, the throttle opening (intake air amount), and the like according to the engine operating state. The fuel injection amount is controlled by the valve opening time of the fuel injection valve 50. The ignition timing is controlled at a predetermined angle with respect to the top dead center (UDC) of the piston 40*a* by causing the spark plug 22 to perform spark-ignition by using an igniter (not shown). The throttle opening is adjusted by driving the motor 15 in conjunction with the depression amount of the accelerator pedal detected by using the accelerator sensor 41. The actuators for the controls are known, and therefore, illustrations thereof are omitted excluding the motor 15 and the fuel injection valve 50. These actuators are driven by using drivers incorporated in the ECU 30. An injection pulse is applied to the drive coil 60 of the fuel injection valve 50 via the driver. Details of the injection pulse will be described later.

(2) Details of the Operation of the Fuel Injection Valve 50:

Next, the operation of the fuel injection valve 50 and the characteristics thereof will be described. As described above, the fuel injection valve 50 lifts the needle valve 54 fixed to the plunger 58 by energizing the drive coil 60 of the built-in solenoid and injects fuel from the opening 53. The injection amount is proportional to the time during which the needle valve 54 is lifted and the opening 53 is opened as long as the pressure of supplied fuel is constant. The lift of the needle valve 54 includes the full lift and the partial lift.

The full lift is a movement of the needle valve 54 when an energization pulse with a sufficient pulse width at a voltage that enables to supply a sufficient current to the drive coil 60 is applied. The energy supplied to the drive coil 60 is determined by the current (flowing current) in the drive coil 60 and the pulse width. From the viewpoint of the ECU 30, the applied voltage and the pulse width are direct control targets, and the applied voltage can be regarded as constant. Therefore, in the following description, the movement of the needle valve 54 is controlled by the pulse width. Hereinafter, the pulse width is also referred to as an energization time during which the injection pulse is applied to the drive coil 60. In a case where the drive coil 60 is energized for a sufficient time, the plunger 58 is lifted against the urging force of the coil spring 57, and the plunger 58 moves until the rear surface of the plunger 58 comes into contact with a stop position inside the case 51. Thus, the plunger 58 is held inn this state for a certain period of time. The fuel injection ends when the plunger 58 and the needle valve 54 return to their original positions after elapse of the energization time of the drive coil 60 caused by application of the voltage.

Figure 3:
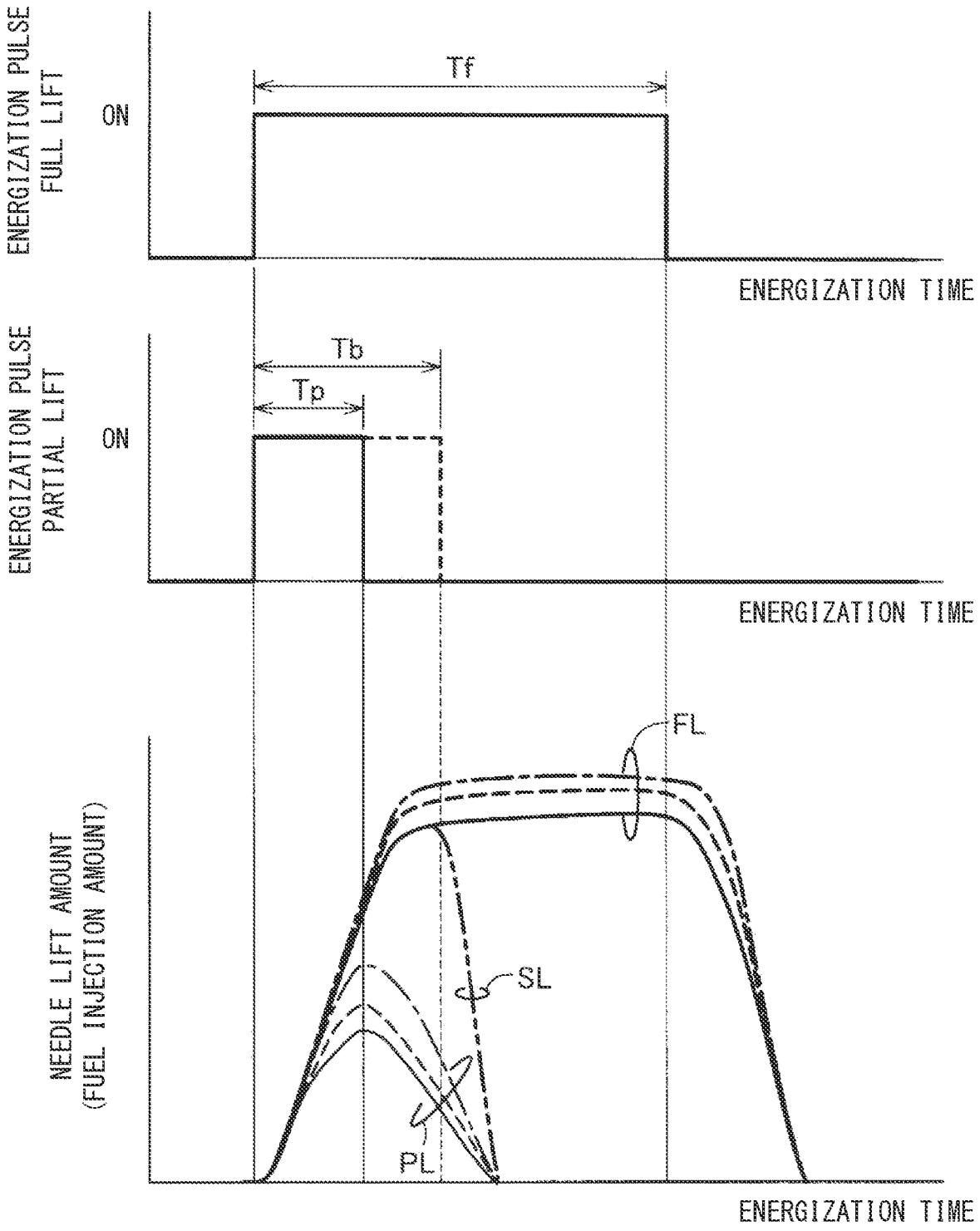
FIG. 3 is a graph showing a relationship among a full lift energization pulse, a partial lift energization pulse, and a lift amount of a needle valve.

The lift amount of the needle valve 54, that is, the fuel injection amount will be described with reference to FIG. 3 for the full lift and the partial lift. The energization pulse in the case of the full lift is shown in the upper view in FIG. 3. The energization pulses in the case of the partial lift is shown in the middle view in FIG. 3. The bottom view in FIG. 3 shows the lift amount of the needle valve 54 corresponding to each energizing pulse. In a case where the energizing pulse applied to the drive coil 60 has a sufficient pulse width, the needle valve 54 is lifted until the back surface of the plunger 58 abuts the case 51 and is maintained in this state. After the energization pulse ends, the needle valve 54 is returned to its original position. The movement of the needle valve 54 varies due to an individual difference in the fuel injection valve 50. Even though, as indicated by the symbol FL in FIG. 3, the behavior of the needle valve 54 in the case of the full lift falls within a certain range of variation.

On the other hand, in a case where the energizing pulse applied to the drive coil 60 has a pulse width that is insufficient to lift the needle valve 54 to the full lift position, the needle valve 54 is not lifted up until the back surface of the plunger 58 abuts the case 51. When the energization pulse ends, the position of the needle valve 54 returns to its original position. This is the movement of the needle valve 54 in the case of the partial lift. In this case, due to the individual difference of the fuel injection valve 50, the movement of the needle valve 54 has a variation larger than the variation FL in the case of the full lift. The behavior of the needle valve 54 in the case of the partial lift exhibits a comparatively large variation, as indicated by the symbol PL in FIG. 3.

When the pulse width of the energizing pulse is extended from the pulse width Tp in the partial lift to the pulse width Tf in the full lift, in some cases, the energization ends just before the needle valve 54 is lifted up and the back surface of the plunger 58 abuts the case 51, the energization ends at the moment when the back surface of the plunger 58 abuts the case 51, or the energization ends immediately after the back surface of the plunger 58 abuts the case 51. In a case where the energization of the drive coil 60 ends immediately after the back surface of the plunger 58 abuts the case 51, in some cases, the plunger 58 and thus the needle valve 54 are not retained, and the needle valve 54 may close at a faster speed than the closing speed at the end of the full lift due to rebound of the plunger 58. This state is shown by a broken line SL in FIG. 3.

Figure 4:
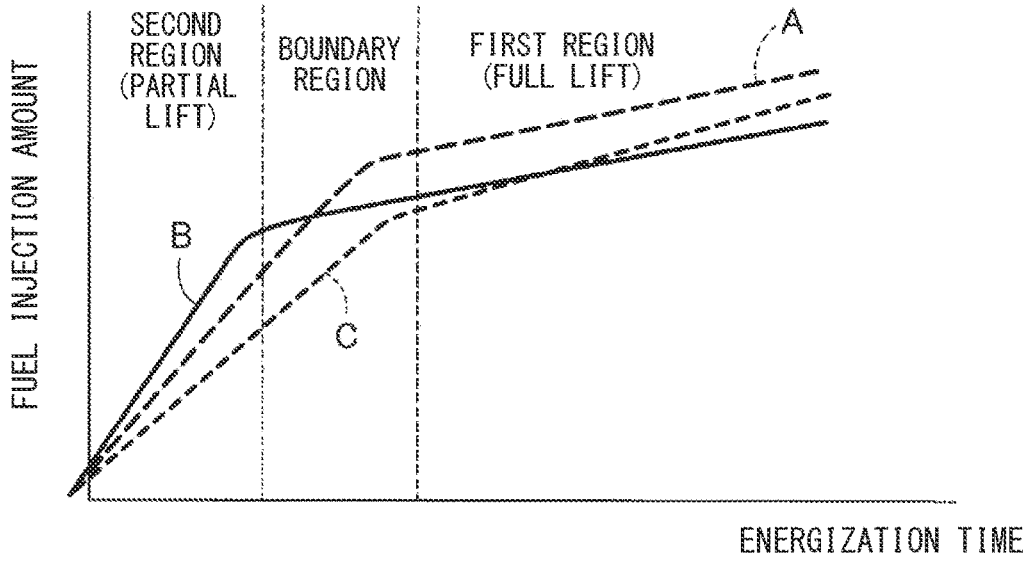
FIG. 4 is an explanatory view showing a correspondence relationship between the energization time and the fuel injection amount.

The fuel injection valve 50 has an individual difference as described above. Therefore, as shown in FIG. 4, the relationship between the pulse width of the energizing pulse and the fuel injection valve may be different for each device. The difference in the relationship is shown between the reference numerals A, B, and C. The energizing of the fuel injection valve 50 includes a boundary energization, a first energization, and a second energization. The boundary energization is to end the energization of the drive coil 60 at the timing when the plunger 58, which is the driving body, is assumed to have moved in the opening direction of the needle valve 54, which is the valve body, to reach the end of the movement range. The first energization is to end the energization at a predetermined timing after the plunger 58 has moved to a position corresponding to the end of the needle valve 54 in the opening direction. The second energization is to end the energization before the plunger 58 moves to the end portion in the opening direction. The relationship between the length of the energization time and the fuel injection amount in the first energization corresponds to that of the full lift, and the fuel injection amount increases with a predetermined inclination as the energization time increases. The range in which the first energization is performed is hereinafter referred to as a first region. The relationship between the length of the energization time and the fuel injection amount in the second energization corresponds to that of the partial lift, and the fuel injection amount increases with an inclination different from that in the first region as the energization time increases. The range in which the second energization is performed is referred to as a second region. Furthermore, a range which is an intermediate range between the two regions and in which the boundary energization is performed is referred to as a boundary region.

The boundary region is a region where a certain inflection point is observed in the relationship between the pulse width of the energizing pulse and the fuel injection amount. The boundary region corresponds to a range of the pulse width Tb that is immediately before the back surface of the plunger 58 abuts the case 51, that is at the moment of abutting the case 51, or that is immediately after abutting the case 51. A variation arises due to an individual difference in the fuel injection valve 50, and therefore, the boundary region exists with a predetermined width between the first region and the second region. A characteristic that has an inflection point around the middle of the boundary region is shown by the character A in FIG. 4. The energization pulse width specified by the characteristic A, that is, the correspondence relationship between the energization time of the drive coil 60 of the fuel injection valve 50 and the fuel injection amount is referred to as a default correspondence relationship of the fuel injection valve 50. This default correspondence relationship is a correspondence relationship defined in advance based on a design value of the fuel injection valve 50 and is stored in the memory 32 of the ECU 30 in a nonvolatile manner.

Figure 5:
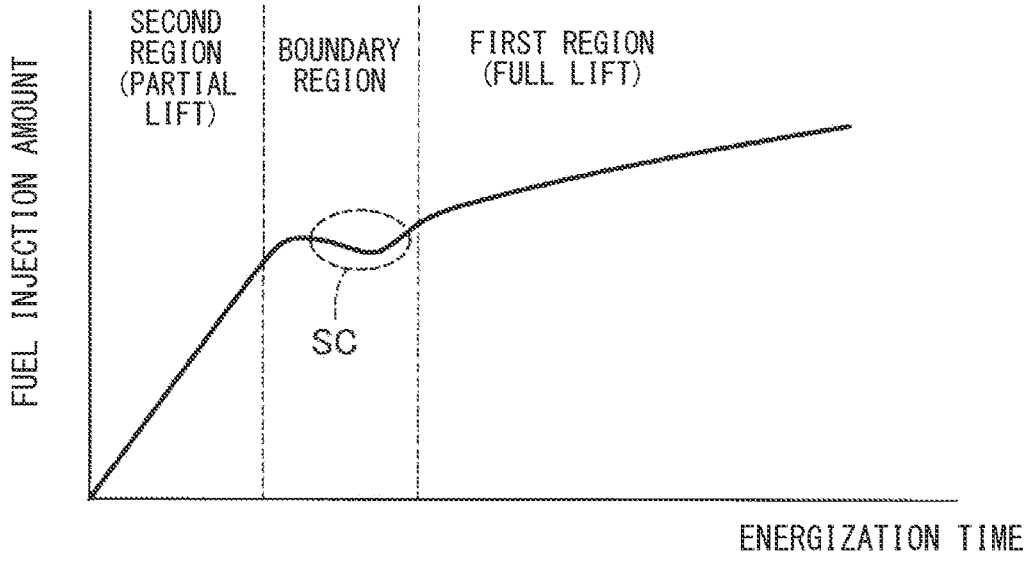
FIG. 5 is an explanatory view showing the relationship in the boundary region in the correspondence relationship between the energization time and the fuel injection amount.

The behavior of the needle valve 54 at the end of the energizing pulse in this boundary region is different from the behavior of the needle valve 54 in the first and second regions, as indicated by the characteristic SL in FIG. 3. As a result, in the vicinity of the pulse width Tb of the energizing pulse, the energizing time and the lift amount of the needle valve 54, that is, the relationship of the fuel injection valve may not have a linear correspondence relationship. This behavior is shown in FIG. 5. As shown in the drawing, a region SC may arise where the fuel injection amount in some cases decreases in the boundary region, although the energization time increases. Hereinafter, the fuel injection control performed by the ECU 30, including the measurement of such characteristics of the fuel injection valve 50, will be described.

Figure 6:
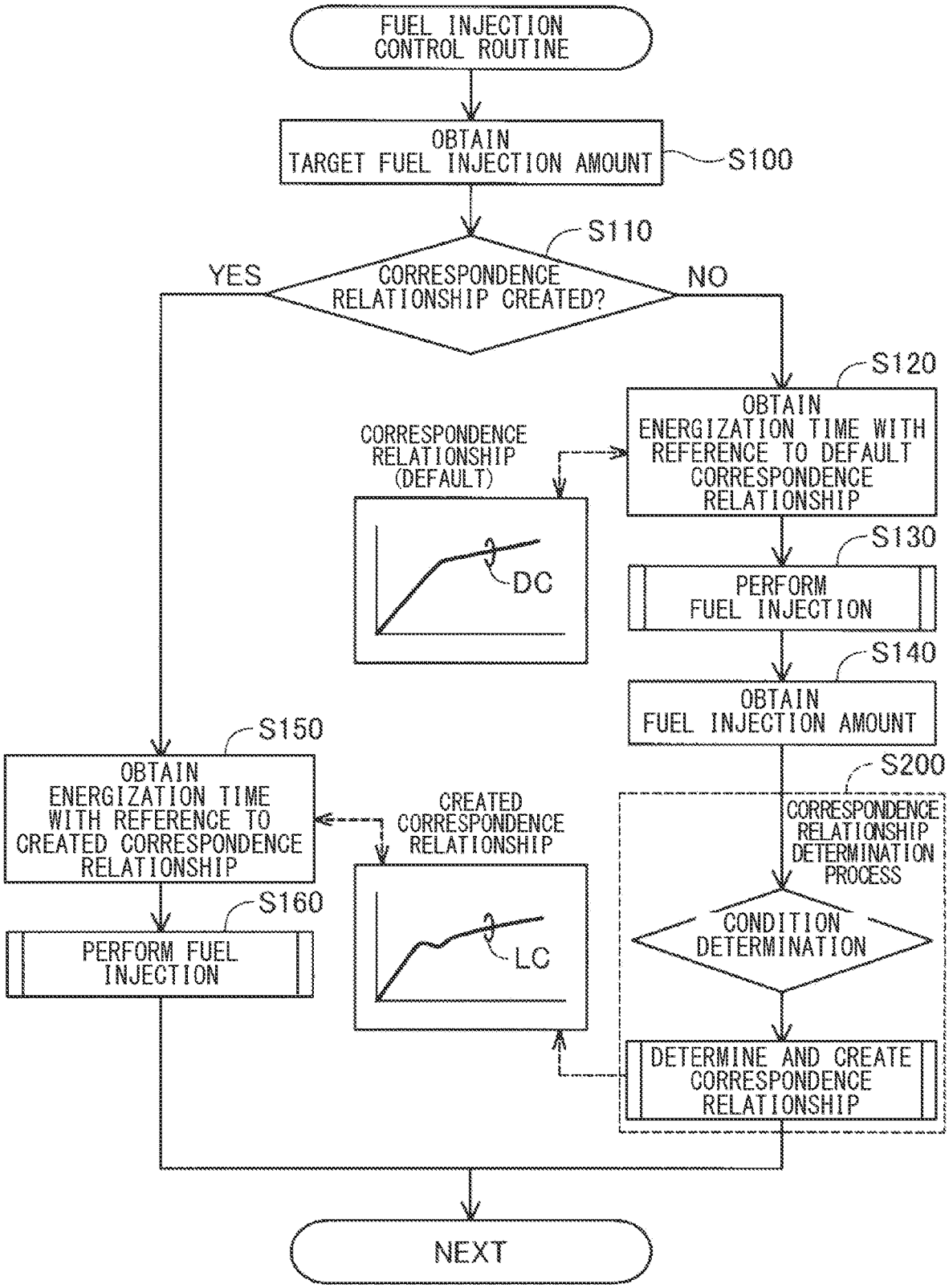
FIG. 6 is a flowchart showing a fuel injection control routine.

(3) Fuel Injection Control:

When an ignition key (not shown) is turned on, the ECU 30 repeatedly executes the fuel injection control routine shown in FIG. 6. When this control routine is started, the ECU 30 first acquires the target fuel injection amount (step S100). The target fuel injection amount is acquired based on the depression amount of the accelerator pedal detected by using the accelerator sensor 41, the vehicle speed acquired based on the crank angle detected by using the crank angle sensor 29, and the like. The target fuel injection amount is also corrected with the cooling water temperature detected by using the cooling water temperature sensor 27 and the like.

After acquiring the target fuel injection amount, the ECU 30 determines whether or not the correspondence relationship between the pulse width of the energizing pulse applied to the fuel injection valve 50 and the fuel injection amount has been created (step S110). Immediately after the engine 11 is started, when the correspondence relationship has not been created, the ECU 30 executes a process for acquiring the energization time for producing the target fuel injection amount with reference to the default correspondence relationship DC stored in the memory 32 (step S120). The energization time for producing the target fuel injection amount is the energization time of the energization pulse applied to the drive coil 60 of the fuel injection valve 50 and is the energization time obtained from the default correspondence DC. The energization time is determined in consideration of a delay time from application of the energization pulse to the drive coil 60 until the needle valve 54 starts moving.

When the energization time of the energization pulse is acquired, fuel injection is next performed (step S130). The ECU 30 applies the energizing pulse to the drive coil 60 of the fuel injection valve 50 to perform fuel injection directly into the cylinder at a predetermined timing in the latter half of the compression stroke. At this time, so as to inject the fuel injection amount as required into the cylinder at one time, the fuel injection may be performed with the full lift, may be performed by combining the full lift with one or more partial lift, or may be performed with multiple partial lifts. The fuel injection for the multiple times may be performed such that the total fuel injection amount performed with the multiple lifts of the needle valve 54 becomes the target fuel injection amount. The energization time of each energization pulse of the fuel injection divided into multiple times may be obtained based on the respective fuel injection amount with reference to the default correspondence DC.

Along with the execution of the fuel injection (step S130), The ECU 30 executes a process for obtaining the fuel injection amount as actually injected (step S140). The fuel injection amount is obtained as follows. After the fuel injection is performed (step S130), the ECU 30 calculates a change in the behavior of the crankshaft 28 caused by the fuel injection. More specifically, the ECU 30 measures an increase amount of the rotation speed of the crankshaft 28 by using the sensor 29 and calculates an increase amount of the rotation speed of the engine caused by the fuel injection. Subsequently, the injection amount is obtained from the increase amount of the rotation speed of the engine with reference to a map or based on a mathematical expression defined in advance. In this way, the fuel injection amount by which the fuel injection valve 50 has injected fuel and that contributes to combustion can be obtained. The map or the mathematical expression may be created to include, for example, a torque of an output shaft 43 produced by fuel injection and may be defined in consideration of an increase amount of the torque detected by using the torque sensor 45.

The ECU 30 performs fuel injection (step S130), obtains the fuel injection amount at that time (step S140), and thereafter, executes a correspondence relationship determination process (step S200). This process is a process for determining the correspondence relationship between the fuel injection amount and the energization time of the energization pulse. The details of the process will be described later. In summary, the process determines a condition in which fuel injection has been performed, modifies the default correspondence relationship, and creates the correspondence relationship LC between the fuel injection amount and the energization time of the energization pulse for the fuel injection valve 50 that has actually injected fuel. The created correspondence LC is stored in the memory 32. Subsequently, the control routine proceeds to "NEXT" and ends.

In this way, when the correspondence relationship LC between the fuel injection amount and the energization time of the energization pulse is created and is stored in the memory 32, this control routine is subsequently started. In step S100 immediately after obtaining the target fuel injection amount, determination of "YES" is made. Therefore, the ECU 30 subsequently acquires the energization time of the energization pulse that produces the target fuel injection amount with reference to the created correspondence relationship (step S150). That is, the ECU 30 acquires the energization time with reference to the correspondence relationship LC created in the correspondence relationship determination process (step S200) executed previously. Subsequently, the ECU 30 performs fuel injection (step S160), and the process proceeds to "NEXT". Thus, the present control routine ends.

The fuel injection control routine has been described above. Step S200 in this control routine, that is, the correspondence relationship determination process will be described with reference to FIG. 7. In the first embodiment, the correspondence relationship determination process is executed by grasping the energization time of the energization pulse in the boundary region and the injection amount correspondingly. When the correspondence relationship determination process is started, first determination is made whether fuel injection has been performed in the boundary region (step S210). As shown in FIG. 4, the boundary region is a region between the first region in which fuel injection is performed with the full lift and the second region in which fuel injection is performed with the partial lift.

Figure 8:
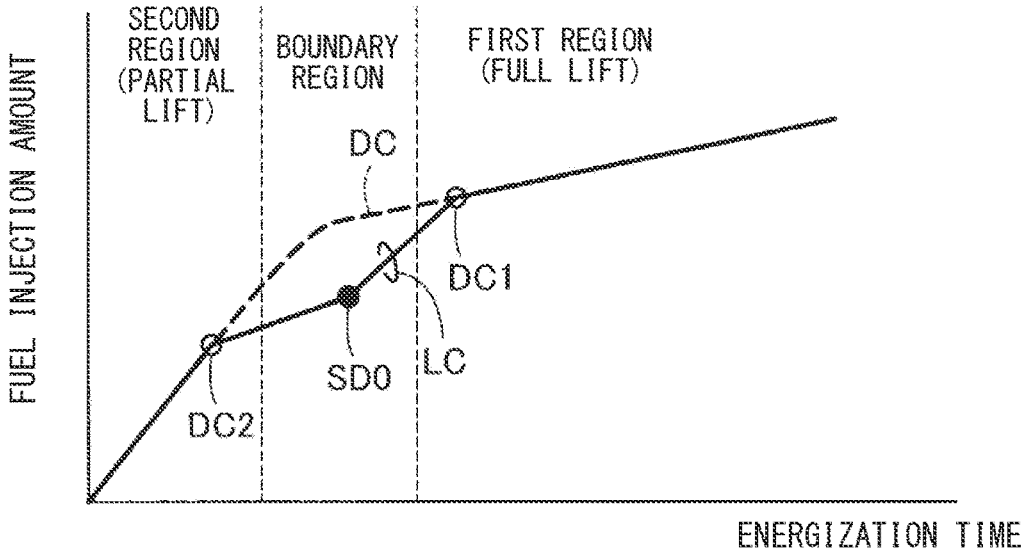
FIG. 8 is an explanatory view showing a relationship between a default correspondence relationship and a created correspondence relationship according to the first embodiment.

When fuel injection is not performed in the boundary region (step S210: "NO"), the process proceeds to "NEXT" and the correspondence relationship determination process is temporarily ended. On the other hand, when fuel injection is performed in the boundary region (step S210: "YES"), the process for determining the correspondence relationship between the energization time of the energization pulse and the actual fuel injection amount is performed by using a detection point obtained from the energization time of the energization pulse in the boundary region and the actual fuel injection amount and the default correspondence DC (step S220). In the first embodiment, as shown in FIG. 8, the detection point SD0 obtained in the boundary region is used to create the correspondence relationship LC that is a modification of the default correspondence DC. The correspondence relationship LC is created by, linearly interpolating the characteristic point DC1 closest to the boundary region in the default characteristics of the first region in the default correspondence DC, the characteristic point DC2 closest to the boundary region in the default characteristics of the second region in the default correspondence DC, and the measured detection point SD0 in the boundary region.

The correspondence LC as modified is created in this way, and the energization time of the energization pulse thereafter is determined with reference to this correspondence LC. Therefore, at least the energizing pulse in the boundary region is determined based on the characteristic closer to the actual correspondence than the default correspondence DC. As a result, the configuration produces an operational effect to enable to cause the fuel injection amount in at least the boundary region to be close to the target fuel injection amount. In addition, in the first embodiment, only one detection point is measured, and therefore, increase in the amount of data newly stored in the memory 32 can be suppressed. The detection point SD0 added to the default correspondence DC is 1 point. Therefore, even in a case where the new correspondence LC is not stored in the memory 32 again, the configuration may perform linear interpolation every time by using the default correspondence DC originally stored in the nonvolatile manner and the detection point SD0 and may enable to obtain the energization time.

B. Second Embodiment

Figure 7:
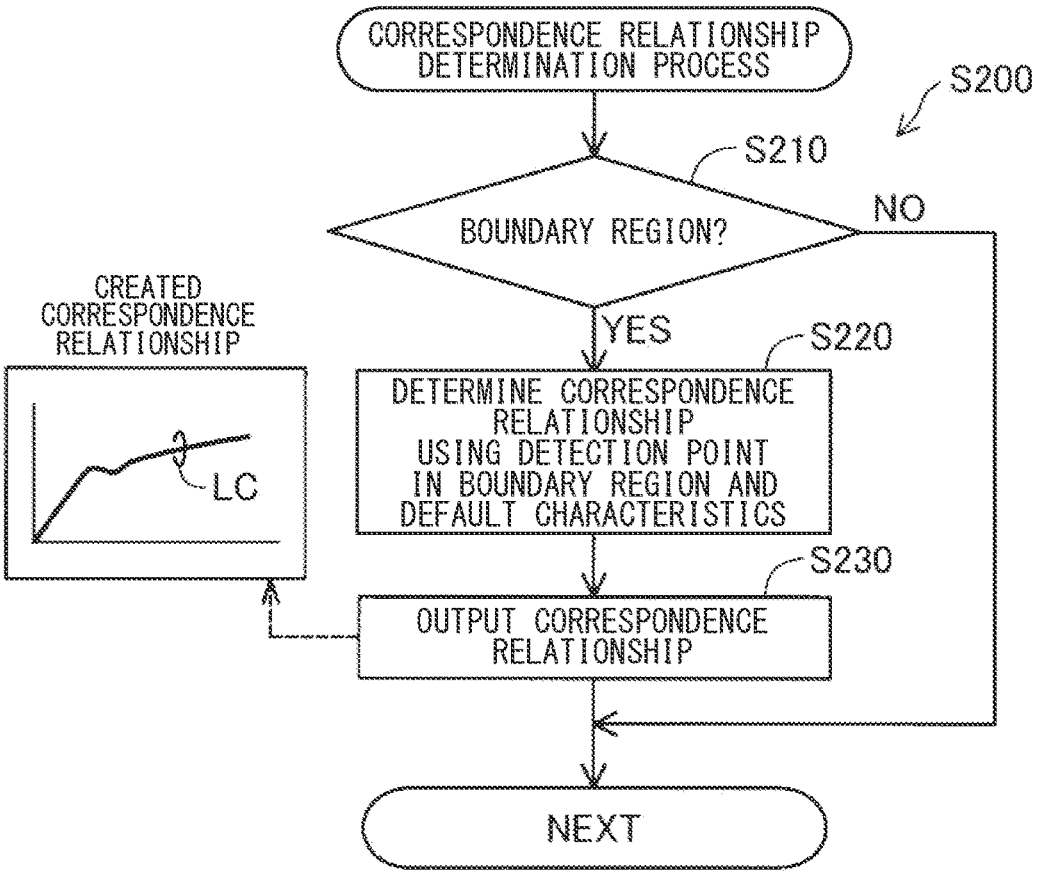
FIG. 7 is a flowchart showing an outline of a correspondence relationship determination process according to a first embodiment.
Figure 9:
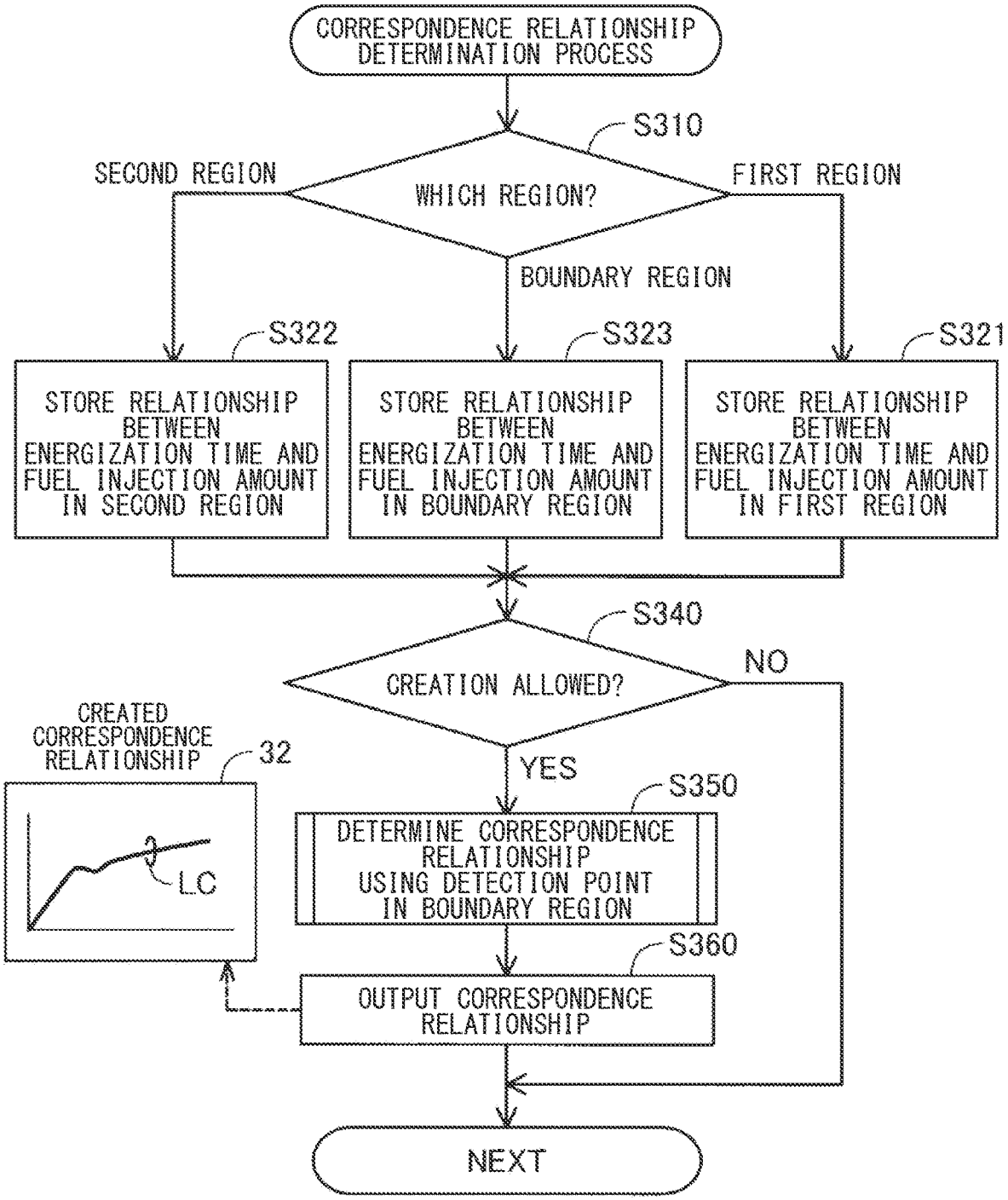
FIG. 9 is a flowchart showing a correspondence relationship determination process according to a second embodiment.

A second embodiment of the present disclosure will be described as follows. The fuel injection control system 10 of the second embodiment has a similar hardware configuration to that of the first embodiment and is different in the processing executed by the ECU 30. FIG. 9 shows a flowchart of the process executed by the ECU 30. In the second embodiment, the fuel injection control routine shown in FIG. 7 is executed. It is noted that, the corresponding relationship determination process (step S200) therein is different from that in the first embodiment.

In the second embodiment, the ECU 30 executes the process shown in FIG. 9 as the correspondence relationship determination processing. When this process is started, it is first determined in which region the fuel injection is performed (step S310). It is determined in which region the fuel injection is performed is to determine whether the fuel injection is performed in the first region in which the fuel injection is performed with the full lift, in the second region in which the fuel injection is performed with the partial lift, or in the boundary region between the first region and the second region.

When it is determined that the fuel injection has been performed in the first region, then the process for storing the relationship between the energization time of the energization pulse and the fuel injection amount in the first region is performed (step S321). As described in the first embodiment, the fuel injection amount can be detected by detecting the change in the output of the engine 11. Similarly, when it is determined that the fuel injection has been performed in the second region, the process for storing the relationship between the energization time of the energization pulse and the fuel injection amount in the second region is performed (step S322). When it is determined that the fuel injection has been performed in the boundary region, the process for storing the relationship between the energization time of the energization pulse and the fuel injection amount in the boundary region is performed (step S323).

After storing the relationship in any of the regions, it is determined whether the corresponding relationship between the energization time of the energization pulse and the fuel injection amount can be created (step S340). When the condition for creating the new correspondence is not satisfied, the process proceeds to "NEXT", and the correspondence relationship determination process ends once. On the other hand, when it is determined that the condition for creating the correspondence is satisfied, the correspondence relationship is created by using at least the detection point in the boundary region (step S350), and the created correspondence LC is stored in the memory 32 (step S360). Subsequently, the routine proceeds to "NEXT" and ends.

In this way, when the condition for creating the new correspondence is satisfied, the correspondence relationship between the energization time of the energization pulse and the fuel injection amount is created and is stored in the memory 32. Therefore, the subsequent fuel injection is performed with reference to the created correspondence relationship LC (FIG. 6, steps S100, 110, 150). As a result, the energization time corresponding to the target fuel injection amount is obtained according to the correspondence relationship created for the fuel injection valve 50 as used instead of the default correspondence relationship, and fuel injection is performed (step S160). Therefore, fuel injection is performed by reflecting the characteristics close to the actual characteristics of the fuel injection valve 50 as used. Thus, accuracy of fuel injection control can be improved.

The condition that allows the correspondence relationship shown in step S340 to be created and the correspondence relationship created in step S350 at that time have various embodiments. The embodiments will be described as follows.

[1] Creation Allowable Condition 1:

It is determined that the creation is allowed on detection of one relationship between the energization time of the energization pulse and the fuel injection amount for each of the first region, the second region, and the boundary region.

Figure 10:
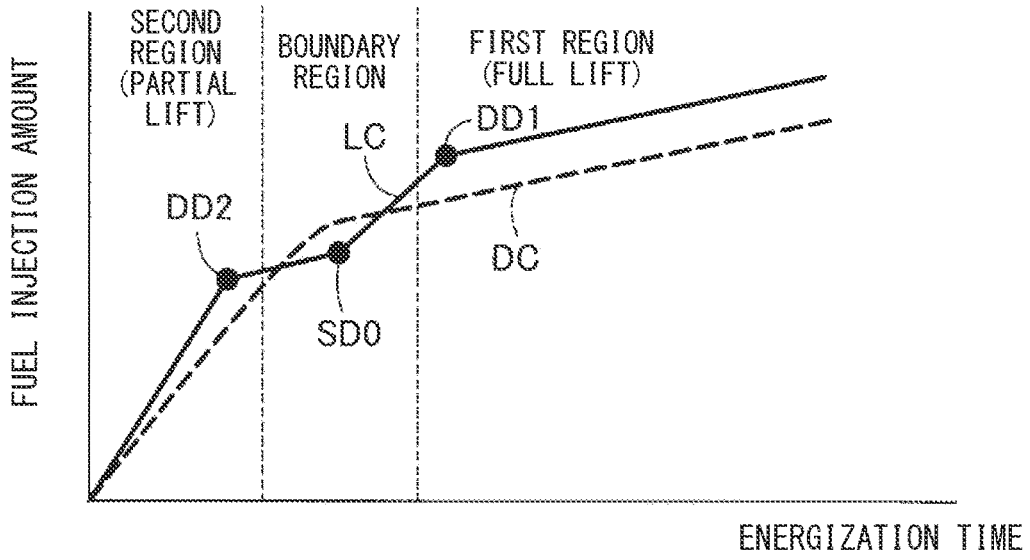
FIG. 10 is an explanatory view showing one relationship between a default correspondence relationship and a created correspondence relationship according to the second embodiment.

As shown in FIG. 10, when one relationship (detection point DD1) between the energization time of the energization pulse and the fuel injection amount is detected in the first region, when one relationship between the energization time of the energization pulse and the fuel injection amount (detection point DD2) is detected similarly in the second region, and when one relationship between the energization time of the energization pulse and the fuel injection amount is detected (detection point SD0) in the boundary region, it is determined that the correspondence relationship can be created. Thus, the new correspondence LC that replaces the default correspondence DC is determined. At this time, the correspondence relationship of the second region is set as connecting the origin with the detection point DD2, and the correspondence relationship of the first region is set as passing through the detection point DD1 and having the same slope as the default correspondence DC. The correspondence relationship in the boundary region is set by connecting the detection points DD2, SD0, DD1 and performing linear interpolation thereamong.

In this way, the correspondence relationship between the energization time of the energization pulse and the fuel injection amount is detected at each of only three detection points. This configuration enables to set the energization time of the energization pulse that produces the target fuel injection amount more accurately than in the case where the default correspondence DC is used. Although three detection points are used, the accuracy around the detection point is steadily enhanced by using the measured relationship. It is noted that, when the correspondence relationship is created in this way, it is desirable that the detection points in the first and second regions be as close to the boundary region as possible. In order to perform detection at the detection point close to the boundary region, for example, in FIG. 9, steps S321 and S322, when the target fuel injection amount is clearly distant from the boundary region, the relationship between the energization time of the energization pulse and the fuel injection amount may not be stored.

[2] Creation Allowable Condition 2:

It is determined that the creation is allowed on detection of multiple relationships between the energization time of the energization pulse and the fuel injection amount for each of the first region and the second region and on detection of one relationship between the energization time of the energization pulse and the fuel injection amount for the boundary region.

Figure 11:
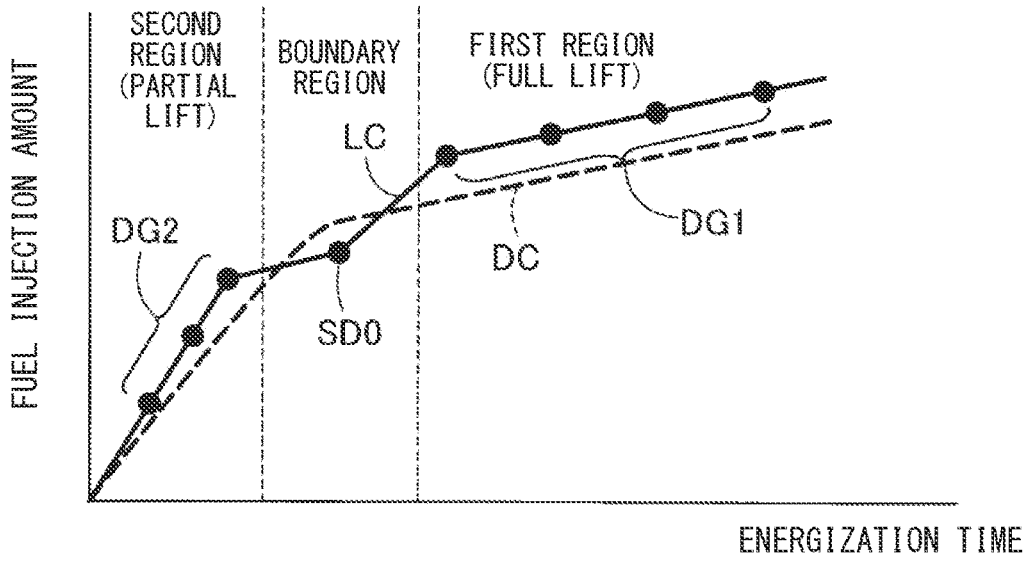
FIG. 11 is an explanatory view showing one relationship between a default correspondence relationship and a created correspondence relationship according to the second embodiment.

As shown in FIG. 11, when multiple relationships (detection point sequence DG1) between the energization time of the energization pulse and the fuel injection amount are detected in the first region, when multiple relationships between the energization time of the energization pulse and the fuel injection amount (detection point sequence DG2) are detected similarly in the second region, and when one relationship between the energization time of the energization pulse and the fuel injection amount is detected (detection point SD0) in the boundary region, it is determined that the correspondence relationship can be created. Thus, the new correspondence LC that replaces the default correspondence DC is determined. The measurement of the multiple detection points included in the detection point sequences DG1 and DG2 in the first region and the second region is performed at different energization times. At this time, the correspondence relationships in the first and second regions are set to connect the multiple detection points included in the detection point sequences DG1 and DG2, respectively. The correspondence relationship in the boundary region is set by connecting the detection point closest to the boundary region in the detection point sequence DG2 in the second region, the detection point SD0 in the boundary region, and the detection point closest to the boundary region in the detection point sequence DG1 in the first region and by performing linear interpolation thereamong. In this way, the state in which the detection point sequences DG1 and DG2 are obtained by performing the detection at the multiple detection points may be referred to as a state in which learning of the characteristic in each region has been completed.

Learning that the detection point sequences DG1 and DG2 belong to the first and second regions, respectively, is performed as follows. The ECU 30 monitors at least one of the voltage applied to the drive coil 60 of the fuel injection valve 50 and the current flowing through the drive coil 60. When a voltage is applied to the drive coil 60 while the valve is open, the plunger 58 is attracted, and the needle valve 54 is lifted up. When the plunger 58 is lifted up and collides against the seating surface of the case 51 that restricts the movement, the movement speed changes abruptly, so that an induced electromotive force greatly changes. On the other hand, when the energization of the drive coil 60 is ended before the plunger 58 is seated and when the plunger 58 does not collide against the seating surface of the case 51, the change in the induced electromotive force is detected as a gradual change. Such changes can be detected by monitoring the voltage between the terminals of the drive coil 60 and the current value. The ECU 30 reads the signal and thereby to determine whether the fuel injection when the voltage is applied to the drive coil 60 for a predetermined energization time is performed in the first region or the second region. Such a technique is a known technique described in, for example, JP-2015-96720A. The ECU 30 obtains the relationship between the energization time of the fuel injection valve 50 and the fuel injection amount for the fuel injection as performed, determines which of the first region or second region the fuel injection is performed, and learns the detection point sequence DG1 and DG2 in the regions, respectively. The learning may be performed by another method. For example, the needle valve 54 or the plunger 58 may be provided with a sensor for detecting the amount of movement thereof to directly detect the movement speed thereof and may determine which of the first region or second region the fuel injection performed belongs to.

In this way, the energization time of the energizing pulse that produces the target fuel injection amount can be set with a higher accuracy by only detecting one detection point SD0 in the boundary region, as compared with the case where the default correspondence DC is used. The number of the detection point in the boundary region is one as in the case of [1] above, and therefore, the accuracy of the boundary region can be similarly enhanced. Further, the multiple detection points are obtained and are linearly interpolated in the first and second regions. Therefore, the correspondence relationship in the first and second regions reflects the individual difference of the fuel injection valve 50, and in these regions, the energization time for the target fuel injection amount can be set with high accuracy.

Figure 12:
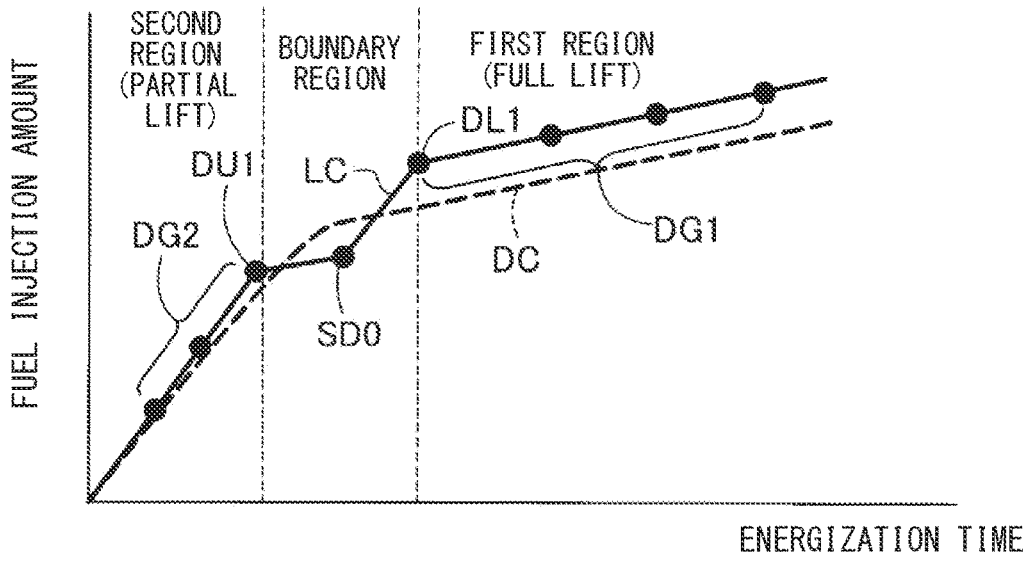
FIG. 12 is an explanatory view showing another example of the created correspondence relationship.

In a case where the correspondence relationship is created as described above, it is desirable that the detection point sequences in the first and second regions be detected so as to include the detection points as close to the boundary region as possible. FIG. 12 shows a case where the detection point sequence DG1 in the first region includes the detection point DL1 at the boundary with the boundary region, and the detection point sequence DG2 in the second region includes the detection point DL2 at the boundary with the boundary region. In this way, the accuracy of the relationship between the energization time of the energizing pulse and the fuel injection amount in the boundary region and its boundary becomes sufficiently high.

[3] Creation Enabled Condition 3:

It is determined that the creation is allowed on detection of multiple relationships between the energization time of the energization pulse and the fuel injection amount for each of the first region and the second region and on detection of at least two relationships between the energization time of the energization pulse and the fuel injection amount for the boundary region.

Figure 13:
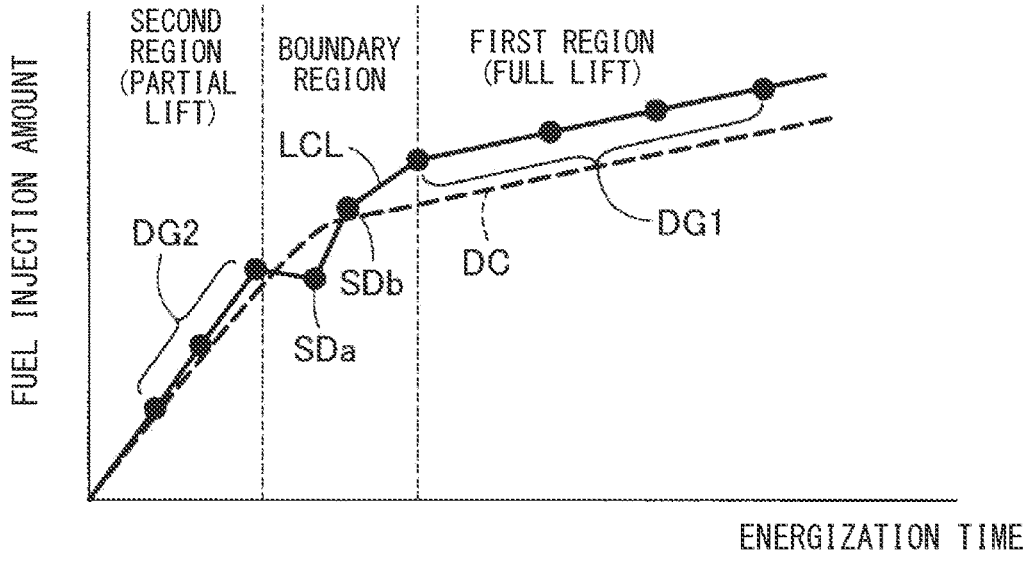
FIG. 13 is an explanatory view showing another example of the created correspondence relationship.

As shown in FIG. 13, when multiple relationships (detection sequence DG1) between the energization time of the energization pulse and the fuel injection amount are detected in the first region, when multiple relationships between the energization time of the energization pulse and the fuel injection amount (detection sequence DG2) are detected similarly in the second region, and when two or more relationships between the energization time of the energization pulse and the fuel injection amount are detected (detection points SDa, SDb) in the boundary region, it is determined that the correspondence relationship can be created. Thus, the new correspondence LCL that replaces the default correspondence DC is determined. At this time, the correspondence relationships in the first and second regions are set to connect the multiple detection points included in the detection point sequences DG1 and DG2, respectively. The detection point at the boundary with the boundary region may be included or may not be included. When the detection point at the boundary with the boundary region is included, the accuracy as a whole can be enhanced. The learning of the detection point sequences DG1 and DG2 may be performed by the same method as the method already described.

In the correspondence relationship in the boundary region, the second region side is set by connecting the detection point among the detection point sequence DG2 in the second region, which is closest to the boundary region, with the detection point SDa on the second region side among the detection points in the boundary region and by performing linear interpolation thereamong. In the correspondence relationship in the boundary region, the first region side is set by connecting the detection point among the detection point sequence DG1 in the first region, which is closest to the boundary region, with the detection point SDb on the first region side among the detection points in the boundary region and by performing linear interpolation thereamong. In the boundary region, the correspondence relationship is set by connecting two or more detection points SDa and SDb as detected and by performing linear interpolation thereamong.

In this way, two or more detection points SDa and SDb are detected in the boundary region. Therefore, the energization time of the energization pulse that produces the target fuel injection amount can be set with higher accuracy than in the case where the default correspondence DC is used. The created correspondence relationship LCL more accurately reflects the individual difference of the fuel injection valve 50 in the boundary region, and therefore, even in the boundary region, the setting of the energization time with respect to the target fuel injection amount can be made with high accuracy.

Figure 14:
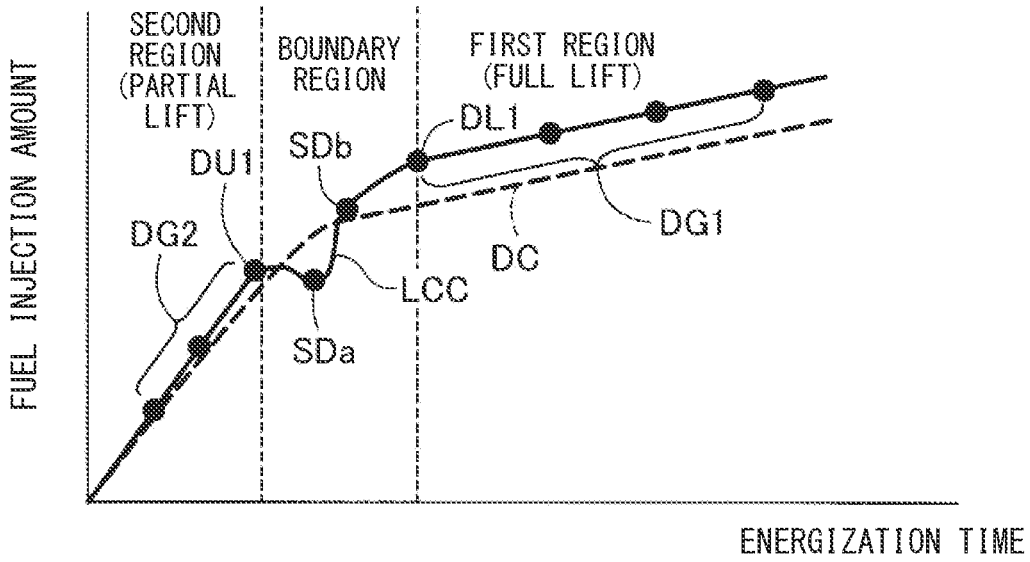
FIG. 14 is an explanatory view showing the difference in the interpolation method in the created correspondence relationship.

As described above, in the case where at least two detection points are detected in the boundary region, the interpolation in the boundary region may be performed as a curve interpolation create the correspondence LCC as illustrated in FIG. 14. The interpolation of the detection point sequences DG1 and DG2 in the first and second regions may also be performed as a curved interpolation. The curve interpolation may be an N-dimensional (N is an integer of 2 or more) interpolation such as a quadratic curve interpolation or a cubic curve interpolation, or may be a Bezier curve interpolation or a spline curve interpolation. The all of the interpolation may be performed as a curved interpolation or only part of the interpolation may be performed as a curved interpolation.

C. Other Embodiments

In the above embodiment, the solenoid incorporated in the fuel injection valve 50 is used as the actuator. It is noted that a linear motor or a piezo element may be used instead of the solenoid. In a case where a piezo element is used and where the deformation amount of a single element is small, multiple piezo elements may be stacked and used.

In each of the above-described embodiments, the fuel injection amount is obtained based on the increase amount of the rotation speed of the engine 11 or the like. It is noted that the fuel injection amount may be detected based on a fluctuation of a fuel supply pressure detected by using a pressure sensor in the fuel supply pipe 65. The fuel in the fuel supply pipe 65 is in a state of being pressurized by the fuel pump 64. When the fuel injection valve 50 is opened and fuel is injected, the pressure in the fuel supply pipe 65 temporarily decreases. Therefore, the fuel injection amount can be obtained by measuring the transient of the fuel supply pressure. When obtaining the fuel injection amount from the fluctuation of the fuel supply pressure, it is desirable to exclude influence of the fuel temperature and influence of multiple injections.

The number of the detection points in the first region and the second region may be the same or may be different from each other. In addition, a relation may be employable such as the number of the detection point in the second region may be one, and the number of detection points in the first region may be two or more. Detection of the detection points SD0, SDa, and the like in the boundary region may be made after detection of the detection point or the detection point sequence in either of the first region or the second region is made. Detection of the detection points SD0, SDa, and the like in the boundary region may be made as appropriate according to the fuel injection amount.

The fuel injection control is performed by the single ECU 30. The fuel injection control may be performed by performing distributed processing by multiple ECUs and computers. Alternatively, the ECU 30 may also perform other control of the engine 11, such as ignition timing control.

<1> In addition, the fuel injection control device may be configured as in the following modes. According to a first mode, a fuel injection control device is provided. This fuel injection control device includes a fuel injection valve configured to receive fuel for the fuel injection valve and to inject fuel by opening and closing a valve body; an actuator including a driving body configured to drive the valve body of the fuel injection valve in an opening direction and a closing direction of the valve body; and an energization control unit configured to energize the actuator to perform fuel injection for an energization time corresponding to a target injection amount with reference to a correspondence relationship between the energization time of the actuator and a fuel injection amount. Herein, the energization control unit may be configured to perform boundary energization to end energization of the actuator at a timing when the driving body moves in the opening direction of the valve body and is assumed to reach an end of its movement range. The energization control unit may be configured to measure a relationship between the energization time until the end of the energization and the fuel injection amount and may determine the correspondence relationship by using the relationship.

<2> In the fuel injection control device, the energization control unit may be configured to perform one or both of a first energization that ends the energization at a predetermined timing after the driving body has moved to an end portion of the valve body in the opening direction; and a second energization that ends the energization before the driving body moves to the end portion, to obtain the relationship between the energization time until the end of the energization and the fuel injection amount, and to determine the correspondence relationship by using the relationship in addition to a relationship between the energization time and the fuel injection amount when the boundary energization is performed. This mode enables to accurately control the fuel injection amount at least in the vicinity of the energization time when the boundary energization is performed.

<3> In the fuel injection control device, the energization control unit may be configured to perform learning of the relationship between the energization time until the end of energization and the fuel injection amount in one or both of the first region for performing the first energization and the second region for performing the second energization, to perform the boundary energization in a boundary region between the first region and the second region, and to measure the relationship between the energization time and the fuel injection amount. The configuration performs the learning of the relationship between the energization time and the fuel injection amount in one or both of the first region and the second region. Therefore, the fuel injection amount control using the fuel injection valve can be performed more accurately.

<4> In the fuel injection control device, the energization control unit may be configured to perform, by the learning, learning of the relationship between the fuel injection amount and the energization time until the end of the energization in one or both of a lower limit of the first region and an upper limit of the second region, and to perform the boundary energization to measure the relationship between the energization time and the fuel injection amount. The present mode performs the learning of the relationship in one or both of the lower limit of the first region and the upper limit of the second region, thereby to enable to bring the correspondence relationship in the boundary region to be closer to the actual characteristic. Thus, the fuel injection amount control can be performed more accurately.

<5> In the fuel injection control device, the measurement of the relationship between the energization time and the fuel injection amount by performing the boundary energization may be made for multiple times with different energization times. The present mode performs the measurement for multiple times, thereby to enable to bring the correspondence relationship in the region where the measurement is performed for the multiple times closer to the characteristics of the fuel injection valve for which the measurement is performed.

<6> In the fuel injection control device, the energization control unit may be configured to determine the correspondence relationship by performing linear interpolation or curved interpolation on multiple measured relationships. Interpolation can be performed easily by employing the linear interpolation, and the characteristics can be brought closer to the actual characteristics by employing the curved interpolation.

<7> As another mode, it may be implemented as a method for controlling the fuel injection valve. The control method of this fuel injection valve may include: energizing an actuator including a driving body that is configured to drive to open and close the valve body of a fuel injection valve, which is configured to receive supply of fuel, in an opening direction and a closing direction to cause the valve body to inject fuel; performing boundary energization that ends energization of the actuator at a timing when the driving body is moved in the opening direction of the valve body and is assumed to have reached an end of its movement range to measure a relationship between the energization time until the energization ends and the fuel injection amount; determining the correspondence relationship between the energization time of the actuator and the fuel injection amount by using the measured relationship; obtaining the energization time corresponding to the target injection amount with reference to the correspondence relationship when the target injection amount is given; and energizing the actuator for the obtained energization time to cause the fuel injection valve to perform fuel injection. This mode enables to control the fuel injection valve with high accuracy and to control the fuel injection amount with high accuracy.

The present disclosure should not be limited to the embodiments described above, and various other embodiments may be implemented without departing from the scope of the present disclosure. For example, the technical features in the embodiments may be replaced or may be combined as appropriate. In addition, as long as a technical feature is not described as essential in the present specification, the technical feature may be deleted as appropriate. For example, part of the configuration produced with hardware in the above embodiment may be produced with software. Further, at least part of the configuration produced with software may be produced with a discrete circuit configuration.

What is claimed is:

1. A fuel injection control device comprising:

a fuel injection valve configured to receive fuel and to inject fuel by opening and closing a valve body;

an actuator including a driving body configured to drive the valve body of the fuel injection valve in an opening direction and a closing direction of the valve body; and an energization control unit configured to energize the actuator to perform fuel injection for an energization time corresponding to a target injection amount with reference to a correspondence relationship between the energization time of the actuator and a fuel injection amount, wherein the energization control unit is configured to perform boundary energization to end energization of the actuator at a timing, when the driving body moves in the opening direction of the valve body and is assumed to reach an end of its movement range and to measure a relationship between the energization time until the end of the energization and the fuel injection amount and to determine the correspondence relationship by using the relationship.

2. The fuel injection control device according to claim 1, wherein the energization control unit is configured to perform a first energization that ends the energization at a predetermined timing after the driving body has moved to an end portion of the valve body in the opening direction to perform a second energization that ends the energization before the driving body moves to the end portion to obtain the relationship between the energization time until the end of the energization and the fuel injection amount and to determine the correspondence relationship by using the relationship in addition to a relationship between the energization time and the fuel injection amount when the boundary energization is performed.

3. The fuel injection control device according to claim 2, wherein the energization control unit is configured to perform learning of the relationship between the energization time until the end of energization and the fuel injection amount in one or both of the first region, in which the first energization is performed, and the second region, in which the second energization is performed, and to perform the boundary energization in the boundary region between the first region and the second region to measure the relationship between the energization time and the fuel injection amount.

4. The fuel injection control device according to claim 3, wherein the energization control unit is configured to perform, by the learning, learning of the relationship between the energization time until the end of the energization and the fuel injection amount in one or both of a lower limit of the first region and an upper limit of the second region, and to perform the boundary energization to measure the relationship between the energization time and the fuel injection amount.

5. The fuel injection control device according to claim 1, wherein the measurement of the relationship between the energization time and the fuel injection amount by performing the boundary energization is made for multiple times with different energization times.

6. The fuel injection control device according to claim 1, wherein the energization control unit is configured to determine the correspondence relationship by performing linear interpolation or curved interpolation on a plurality of measured relationships.

7. A method for controlling a fuel injection valve, comprising:

energizing an actuator including a driving body that is configured to drive to open and close the valve body of a fuel injection valve, which is configured to receive supply of fuel, in an opening direction and a closing direction to cause the valve body to perform fuel injection;

performing boundary energization that ends energization of the actuator at a timing when the driving body is moved in the opening direction of the valve body and is assumed to have reached an end of its movement range to measure a relationship between the energization time until the energization ends and the fuel injection amount;

determining the correspondence relationship between the energization time of the actuator and the fuel injection amount by using the measured relationship;

obtaining the energization time corresponding to the target injection amount with reference to the correspondence relationship when the target injection amount is given; and energizing the actuator for the obtained energization time to cause the fuel injection valve to perform fuel injection.

8. A fuel injection control device comprising:

at least one computer configured to:

energize an actuator including a driving body that is configured to drive to open and close the valve body of a fuel injection valve, which is configured to receive supply of fuel, in an opening direction and a closing direction to cause the valve body to perform fuel injection;

perform boundary energization that ends energization of the actuator at a timing when the driving body is moved in the opening direction of the valve body and is assumed to have reached an end of its movement range to measure a relationship between the energization time until the energization ends and the fuel injection amount;

determine the correspondence relationship between the energization time of the actuator and the fuel injection amount by using the measured relationship;

obtain the energization time corresponding to the target injection amount with reference to the correspondence relationship when the target injection amount is given; and energize the actuator for the obtained energization time to cause the fuel injection valve to perform fuel injection.

* * * * *